US006580200B2

(12) United States Patent
Fukuyo et al.

(10) Patent No.: US 6,580,200 B2
(45) Date of Patent: Jun. 17, 2003

(54) DISCHARGE LAMP AND MANUFACTURING METHOD THEREOF

(75) Inventors: Takeshi Fukuyo, Shizuoka (JP); Shinichi Irisawa, Shizuoka (JP); Yoshitaka Ohshima, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 51 days.

(21) Appl. No.: 09/878,941

(22) Filed: Jun. 13, 2001

(65) Prior Publication Data

US 2002/0008471 A1 Jan. 24, 2002

(30) Foreign Application Priority Data

Jun. 13, 2000 (JP) ..... P2000-176497

(51) Int. Cl.[7] ..... H01J 61/30; H01J 9/24

(52) U.S. Cl. ..... 313/25; 313/34; 313/570; 313/634; 445/39; 445/42; 445/54; 445/56

(58) Field of Search ..... 313/25, 34, 20, 313/570, 634; 445/26, 38, 40, 53, 56, 39, 54, 57, 42

(56) References Cited

U.S. PATENT DOCUMENTS 4,808,876 A * 2/1989 French et al. ..... 313/25
4,935,668 A * 6/1990 Hanser et al. ..... 313/634 X
4,949,003 A * 8/1990 Cox et al. ..... 313/25
5,936,349 A 8/1999 Fukai et al. ..... 313/623

FOREIGN PATENT DOCUMENTS

JP 10-27574 1/1998 ..... H01J/61/36

* cited by examiner

*Primary Examiner*—Ashok Patel
(74) *Attorney, Agent, or Firm*—Sughrue Mion, PLLC

(57) ABSTRACT

A discharge bulb including: an arc tube having a light emitting portion constructed in a manner that a light emitting substance is enclosed therein by pinch-sealing the arc tube, and discharge electrodes are oppositely arranged therein; and a shroud glass tube hermetically sealing and covering the arc tube, so as to form a space between the shroud glass tube and the arc tube. And a water content or pressure of gas enclosed in the sealed space is specified.

10 Claims, 5 Drawing Sheets

G1
V
11a
11b
13a
Q1
12b
A1
6
7
8b
12a
K
M1
A2
8a
8a'
EXHAUST
Xe
M2
17
11c
Q2
13b
16b
16a
18

DISCHARGE LAMP AND MANUFACTURING METHOD THEREOF

BACKGROUND OF THE INVENTION

1. Field of the Invention

The present invention relates to a bulb for a discharge lamp used as a vehicle lighting device. More particularly, the present invention relates to a bulb for a discharge lamp, with improved durability due to a specific water content or pressure of gas enclosed in a hermetically sealed space between an arc tube including a light emitting portion-of a discharge bulb and a shroud glass tube surrounding the arc tube.

2. Description of the Related Art

Recently, discharge bulbs have been used as vehicle lighting devices such as head lamps for automobiles. Typically, discharge lamps having the following structure have been employed. Light is emitted by a discharge phenomenon between electrodes oppositely arranged in a glass bulb, in which a xenon gas is enclosed.

The structure of the discharge bulb will be schematically described below. First, discharge electrodes made of tungsten are oppositely arranged in a sealed space (sealed chamber) obtained by pinch-sealing a long, thin, glass tube at a predetermined interval, so as to form an arc tube including a spherical light emitting portion provided therein. The light emitting portion is filled with a starting gas (xenon gas), mercury and metal halide (hereinafter, referred to as "light emitting substance").

In order to cut an ultraviolet component-having a wavelength harmful to human eyes-from the light emitted from the light emitting portion, a substantially cylindrical shroud glass tube is provided so as to seal and surround the arc tube. Conventionally, in the discharge bulb, an atmospheric air has been enclosed in a sealed space between the arc tube and the shroud glass tube.

However, the conventional art has the following technical problems.

(1) In the case where an atmospheric air containing much water is enclosed in the sealed space between the arc tube and the shroud glass tube, when the discharge bulb is repeatedly turned on and off, a temperature remarkably varies in the sealed space. For this reason, the sealed space easily becomes dewy. When the sealed space is dewy, a capillary condensation of water content gradually occurs in a narrow gap between the sphere-shaped, bulged, light emitting portion of the arc tube and the shroud glass tube. As a result, disadvantageously, devitrification (whitening) and expansion of the light-emitting portion easily occur. In particular, when glass is formed, a gas containing water content more than the atmospheric air is exhausted from a burner and is enclosed within the sealed glass tube, whereby a critical problem arises.

(2) A xenon gas is usually enclosed in the light emitting portion at about 5 to 10 atmospheres pressure and, thus, an internal pressure of the light emitting portion arrives at several tens of atmospheres pressure when the discharge bulb is turned on. For this reason, when the turn-on time becomes long, the light emitting portion is gradually expanded and, then, closely approaches an inner wall surface of the shroud glass tube. As a result of the above, devitrification is generated. Moreover, the light emitting portion contacts with the inner wall surface of the shroud glass tube, resulting in leakage or breakdown.

SUMMARY OF THE INVENTION

The present invention has been made in view of the problems in the prior art. It is, therefore, an object of the present invention to improve durability of discharge bulbs by specifying a predetermined range of water content or pressure for gas enclosed in a sealed space between an arc tube of the discharge bulb and a shroud glass tube surrounding the arc tube.

In order to achieve the above and other objects, the following aspects of the invention have been employed.

More specifically, according to a first aspect, the present invention provides a discharge bulb including: an arc tube having a light emitting portion constructed in a manner that a light emitting substance or the like is enclosed therein by pinch-sealing the arc tube, and discharge electrodes are oppositely arranged therein; and a shroud glass tube hermetically sealing and covering the arc tube so as to form a sealed space between the shroud glass tube and the arc tube, wherein a water content of the gas enclosed in the sealed space is set to less than 130 ppm.

In this aspect, since the water content of air existing in the sealed space is made low, the dew point becomes less than −40° C. Therefore, even if the discharge bulb is repeatedly turned on and off, the sealed space does not easily become dewy, and there is no possibility of facilitating devitrification (whitening) or expansion of the light emitting portion by capillary condensation of the water content generated in a narrow space between the light emitting portion of the arc tube and the shroud glass tube.

Further, according to a second aspect, the present invention provides the discharge bulb according to the first aspect, but is further characterized in that the light emitting portion is formed so as to closely approach an inner wall surface of the shroud glass tube, and the sealed space is filled with a gas within a range from a lower atmospheric pressure limit, calculated by 3–6 d, to an upper limit of 15 atmospheres pressure, wherein a distance from the inner wall surface of the shroud glass tube to a zenith portion of the light emitting portion is set as reference numeral d (in the unit of mm).

In this aspect, the distance d from the inner wall surface of the shroud glass tube to the zenith portion of the light emitting portion is set to a proper value, and a pressure of the sealed space is specified. By doing so, it is possible to reduce a generation of devitrification, leak, and breakdown, of the light-emitting portion. Moreover, the light emitting portion does not reach an abnormally high temperature by the thermally conductive effect of the gas. Therefore, it is possible to prevent the glass from being softened and expanded.

In this case, the calculating equation "3–6d"—for determining the lower atmospheric pressure limit—is obtained from an experiment conducted in order to obtain a relation between an expansion length of the light emitting portion and a pressure of the sealed space when turning on the discharge bulb.

Further, according to a third aspect, the present invention provides a manufacturing method of a discharge bulb having (i) an arc tube having a light emitting portion constructed in a manner that a light emitting substance or the like is enclosed therein by pinch-sealing a glass tube, and discharge electrodes are oppositely arranged, and (ii) a shroud glass tube hermetically sealing and covering the arc tube so as to form a space between the shroud glass tube and the arc tube, wherein the method includes:

a gas filing process for filling a gas into the space, wherein the gas filling process includes a gas introducing process for introducing a gas having a specified water content of less than 130 ppm into the space; and a sealing process for sealing the shroud glass tube so as to seal the space.

In this aspect, by specifying the water content of the sealed space, it is possible to manufacture a discharge bulb that does not easily become dewy, even when the discharge bulb is repeatedly turned on and off.

Further, according to a fourth aspect, the present invention provides the manufacturing method of a discharge bulb according to the third aspect, but further characterized in that the gas introducing process is carried out within a range from 0.3 to 15 atmospheres pressure. By doing so, it is possible to manufacture a discharge bulb that can securely prevent an expansion of the light emitting portion.

Further, according to a fifth aspect, the present invention provides the manufacturing method of a discharge bulb according to either the third or fourth aspects, but further characterized in that the sealing process is carried out so that the shroud glass tube is cooled, whereby the gas is liquefied. By doing so, it is possible to fill the tube with gas having 1 atmosphere pressure or more.

As described above, the present invention improves durability (long life) of a discharge bulb. That is, the present invention contributes to improvement in the quality of discharge bulbs.

BRIEF DESCRIPTION OF THE DRAWINGS

The above and other objects and advantages of the present invention will become more apparent by describing in detail preferred exemplary embodiments thereof with reference to the accompanying drawings, wherein like reference numerals designate like or corresponding parts throughout the several views, and wherein.

DETAILED DESCRIPTION OF THE PREFERRED EMBODIMENTS

Next, preferred embodiments of the present invention will be described below with reference to the accompanying drawings.

Figure 1:
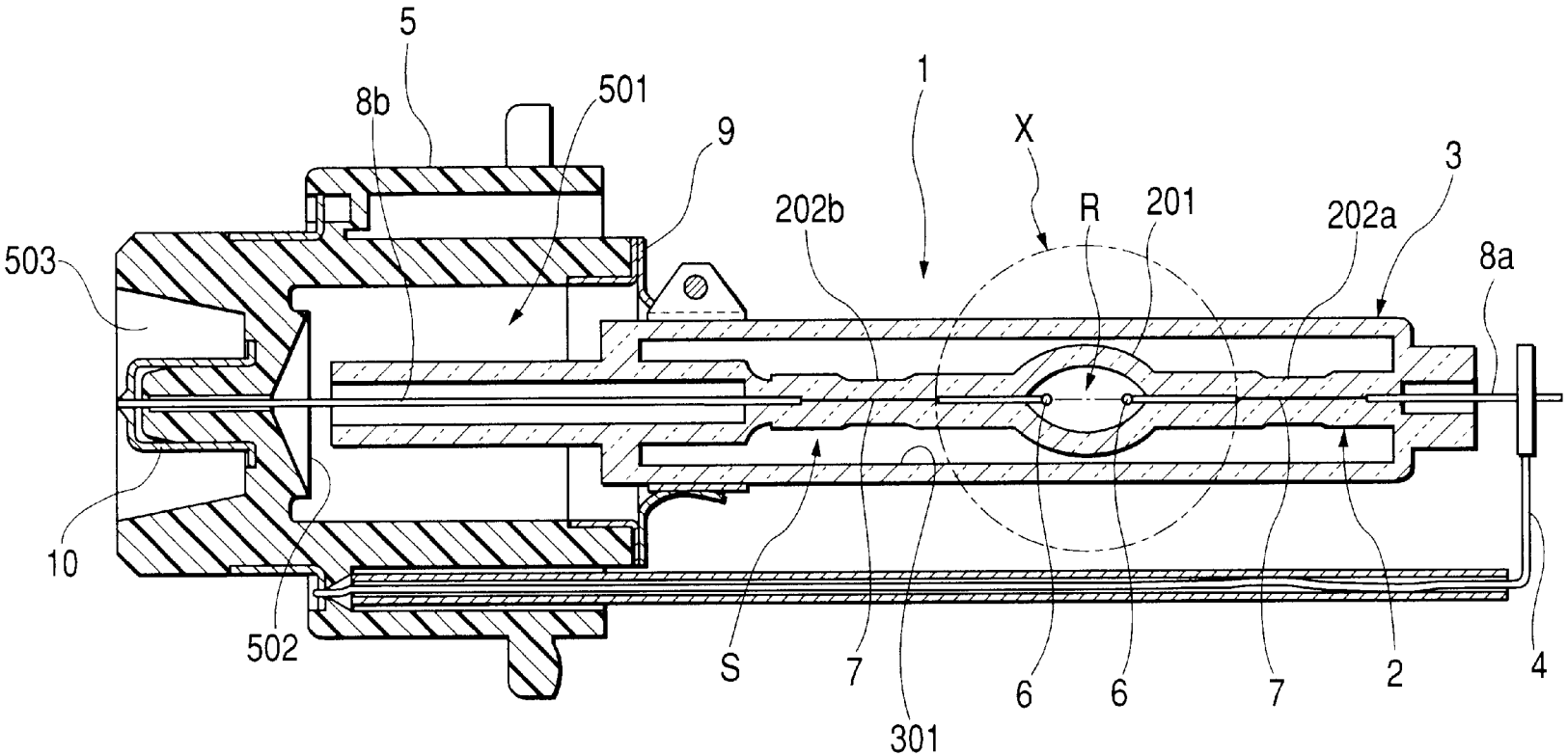
FIG. 1 is a cross sectional view showing an internal structure of a discharge bulb according to the present invention.

First, the overall structure of a discharge bulb 1 of the present invention will be described below with reference to FIG. 1, which is a cross sectional view showing an internal structure of the discharge bulb 1 according to the present invention.

The discharge bulb 1 is one kind of electric lamp used mainly as a headlamp of an automobile or the like. In FIG. 1, reference numeral 2 denotes an arc tube formed out of a thin and long cylindrical glass tube GI (see FIGS. 5(*a*) to 5(*b*)) via a predetermined process.

A front end portion of the arc tube 2 is supported by one lead support 4 that projects forwardly from an isolative base 5. On the other hand, a rear end portion of the arc tube 2 is held by a metal support member 9 that is fixed on the front side of the isolative base 5.

A lead wire 8*a* led out of the front portion of the arc tube 2 is fixed to the lead support 4 by welding. On the other hand, a lead wire 8*b*, led out of the rear portion of the arc tube 2, penetrates through a recess portion 501 formed inside the isolative base 5, and through a bottom surface wall 502 (forming the recess portion 501). Further, the lead wire 8*b* is welded and fixed to a terminal 10 fixed to a predetermined area 503 at the rear portion of the bottom surface wall 502.

Moreover, the arc tube 2 is formed with a light emitting portion 201, which includes discharge electrodes 6 and 6, and a light emitting space R. The discharge electrodes 6 and 6 are oppositely arranged between a pair of front and rear pinch seal portions 202*a* and 202*b*, whereas the light emitting space R is filled with a light emitting substance K or the like. See FIG. 5(*c*), for example. The light emitting portion 201 is formed so as to be bulged to the outside by thermoforming a cylindrical glass tube $G_1$, and has a substantially glass spherical shape.

In the pinch seal portions 202*a* and 202*b*, molybdenum foils 7 and 7 are sealed in order to connect tungsten discharge electrodes 6 and 6 with molybdenum lead wires 8*a* and 8*b* led out of the front and rear of the pinch seal portions 202*a* and 202*b*. By doing so, an airtight performance can be secured in the pinch seal portions 202*a* and 202*b*.

Reference numeral 3 denotes a member called generally as a shroud glass tube. The shroud glass tube 3 is a cylindrical glass tube surrounding the arc tube 2 so that the arc tube 2 is sealed. A sealed space S, having a predetermined volume, is formed between the shroud glass tube 3 and the arc tube 2.

The shroud glass tube 3 is provided in order to cut an ultraviolet component-having a wavelength band that is harmful to the human eye emitted from the light emitting portion 201, and in order to protect the arc tube 2.

In this case, the discharge bulb 1 of the present invention is not limited to the above-mentioned structure including the arc tube 2 and the shroud glass tube 3. The discharge bulb 1 may be, of course, any other form so long as it includes the arc tube 2 having the light emitting portion 201 emitting a light by discharge, and includes the shroud glass tube 3 forming a sealed space S between the arc tube 2 and the shroud glass tube.

Figure 2:
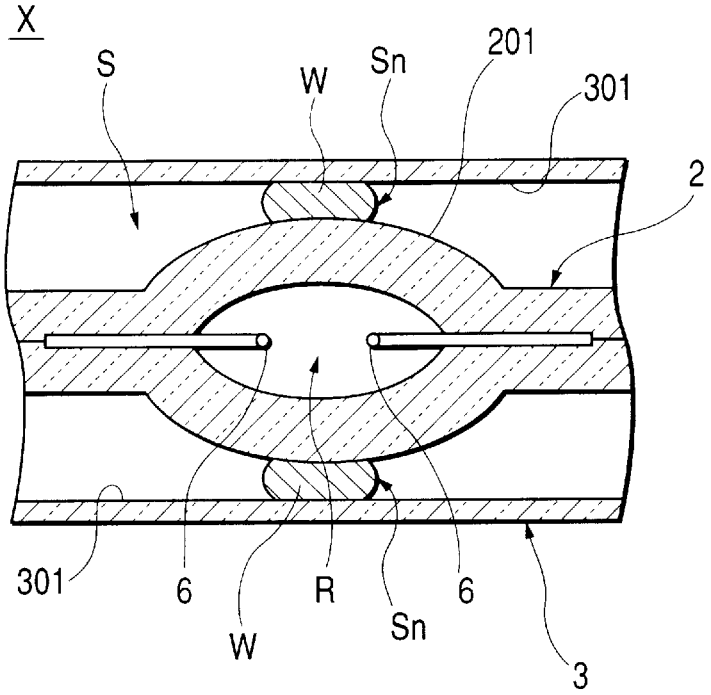
FIG. 2 is an enlarged view showing the area surrounding (X portion of FIG. 1) a light emitting portion of the discharge bulb, and showing a dewy state.
Figure 3:
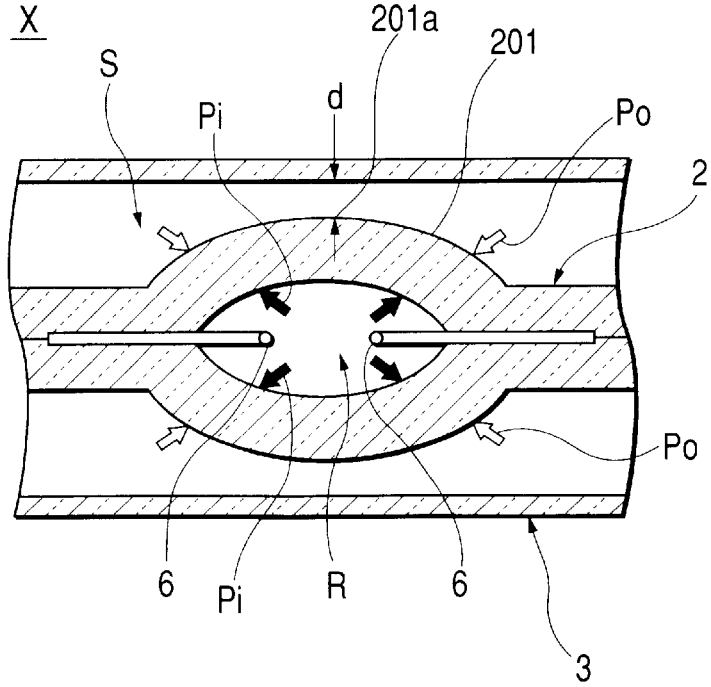
FIG. 3 is an enlarged view showing the surrounding area X, as in FIG. 1, and showing a state of internal pressure.

FIG. 2 and FIG. 3 are individually enlarged views showing the area surrounding (X portion in FIG. 1) the light emitting portion 201 of the discharge bulb 1 of the present invention. The light emitting portion 201 is bulged to the outside like a glass sphere, and closely approaches an inner wall surface 301 of the shroud glass tube 3 so as to form a narrow space Sn in the sealed space S.

When an atmosphere containing much water content is enclosed in the sealed space S between the arc tube 2 and the shroud glass tube 3, and when the discharge bulb 1 is repeatedly turned on and off, a temperature remarkably varies in the sealed space S between the arc tube 2 and the shroud glass tube 3.

For this reason, the sealed space S easily becomes dewy. When the sealed space S is dewy, a capillary condensation (see FIG. 2) of water content W gradually occurs in the narrow space Sn. As a result, there is a possibility of facilitating devitrification (whitening) and expansion of the light emitting portion 201.

In order to solve the above-described disadvantages, the inventors of the present invention have proposed a technical concept for making the dew point low, and for making it hard for the discharge bulb 1 to become dewy, by specifying that the water content of the sealed space S is less than a predetermined value. First, the inventors conducted the following verifiable experiment (hereinafter, referred to as "Experiment 1").

Experimental conditions:

Twenty (20) discharge bulbs were prepared in total and, then, divided into four groups A to D having five discharge bulbs each. Further, a water content of each sealed space S of these groups was set to different conditions and, then, visible confirmation was carried out with respect to generation of devitrification or breakdown. In the sealed space S, an argon gas was enclosed under the condition of an atmospheric pressure of 0.5 (506 hPa). The water content of each group was set as follows: group A, 400 ppm; group B, 130 ppm; group c, 40 ppm; and group D, 10 ppm. The dew point corresponding to the water content was, respectively for each group, −30° C., −40° C., −50° C. and −60° C. per atmospheric pressure. The result of Experiment 1 is shown in the following Table 1.

TABLE 1

| | Group A | Group B | Group C | Group D |
|---|---|---|---|---|
| Water content (ppm) | 400 | 130 | 40 | 10 |
| Dew point (° C.) | −30 | −40 | −50 | −60 |
| Generation of breakdown, etc. (number of bulbs) | 2/5 | 0/5 | 0/5 | 0/5 |
| Determination whether or not bulb is defective | X | ○ | ○ | ○ |

In Table 1, a mark ○ is indicative that the quality of the discharge bulb is non-defective; on the other hand, a mark X is indicative that the quality of the discharge bulb is defective.

As seen from the experiment result, in the groups B to D that specify a the water content of the sealed space S less than 130 ppm and a dew point less than −40° C., no devitrification or breakdown was observed, and a very preferable quality was obtained. More specifically, the water content of the sealed space S is specified less than 130 ppm and, thereby, it is possible to securely prevent devitrification or breakdown of the discharge bulb 1.

Next, the inventors have found the following technical concept in the case where the atmosphere is enclosed in the sealed space S at a negative pressure. More specifically, a xenon gas of about 5 to 10 atmospheric pressure is usually enclosed in the light emitting portion 201, and when the discharge bulb is turned on, an internal pressure of the light emitting portion 201 arrives at several tens of atmospheric pressure. For this reason, the turn-on time becomes long, the light emitting portion is gradually expanded and, then, closely approaches the inner wall surface 301 of the shroud glass tube 3; as a result, the light emitting portion 201 is devitrified, and the enclosed gas leaks from there. In the worst case, the light emitting portion 201 is broken down. Namely, in the case where the atmosphere is enclosed in the sealed space S at a negative pressure, it was found that it is impossible to prevent an expansion of the light emitting portion 201.

In order to solve the above-described problem, a distance d from the inner wall surface of the shroud glass tube 3 to the zenith portion 201*a* of the light emitting portion 201 is set to a proper value, and an internal pressure of the sealed space S formed by the shroud glass tube 3 is specified. By doing so, the inventors have made a proposal to reduce a generation of devitrification, leak, and breakdown, of the light emitting portion.

The inventors of the present invention conducted the following experiment (hereinafter, referred to as "Experiment 2") in order to obtain the relation between an expansion length of the light emitting portion 201 and a pressure of the sealed space S when turning on the discharge bulb. The Experiment 2 was conducted in the following manner. More specifically, an argon gas was enclosed in the sealed space S and, then, a sample having different enclosed pressure $P_o$ was prepared. Thereafter, an expansion length of the light emitting portion 201 was measured at the point of time when 3000 hours elapsed from the turn-on of the discharge bulb. In this case, a distance d from the inner wall surface 301 of the shroud glass tube 3 to the zenith portion 201*a* of the light emitting portion 201 is 0.45 mm at the point of time when starting the turn-on of the discharge bulb.

Figure 4:
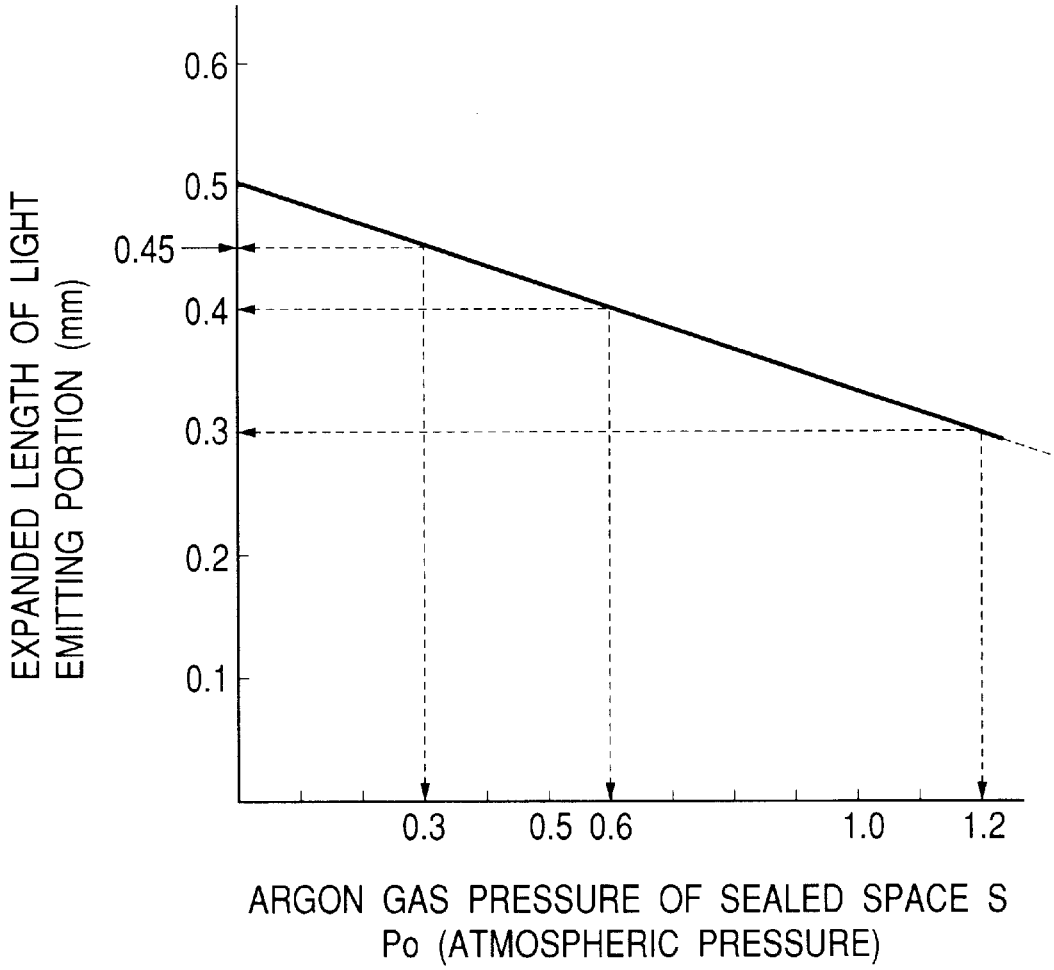
FIG. 4 is a graph showing the result of experiment 2.

FIG. 4 is a graph showing the result of Experiment 2. In the graph of FIG. 4, along the abscissa is denoted argon gas pressure $P_o$ (in atmospheres pressure) of the sealed space S, and along the ordinate is denoted expansion length of the light emitting portion 201 after 3000 hours elapsed from the turn-on of the discharge bulb. As is evident from FIG. 4, when the pressure $P_o$ of the sealed space S becomes lower than 0.3 atm, the expansion length of the light emitting portion 201 exceeds 0.45 mm. As a result, it was found that the light emitting portion 201 closely approaches the inner wall surface 301 of the shroud glass tube 3. For this reason, the light emitting portion 201 is devitrified, and the enclosed gas leaks from there, and in the worst case, the light emitting portion 201 is broken down.

Based on FIG. 4 (result of Experiment 2), the inventors found the following technical concept. More specifically, when a distance from the inner wall surface 301 of the shroud glass tube 3 to the zenith portion 201*a* of the light emitting portion 201 is set as d (in the unit of mm), a lower limit pressure on which an expansion length d of the light emitting portion 201 ranges within the distance d is calculated from the equation of $P_o=3-6\times d$. For example, in the case where the distance d is 0.4 mm, the lower limit pressure $P_o$ is 0.6 atm=3−6×0.4, and in the case where the distance d is 0.3 mm, the lower limit pressure $P_o$ is 1.2 atm3−6×0.3. On the other hand, when the pressure $P_o$ of the sealed space S is made larger than 15 atmospheres pressure (not shown), it was found that the shroud glass tube 3 is easily broken down by the pressure $P_o$. Therefore, it is preferable that the pressure $P_o$ enclosed in the sealed space S is set to a range more than 3−6 d atm and less than 15 atm.

Figures 5A, 5B, 5C, 5D, 5E, 5F:
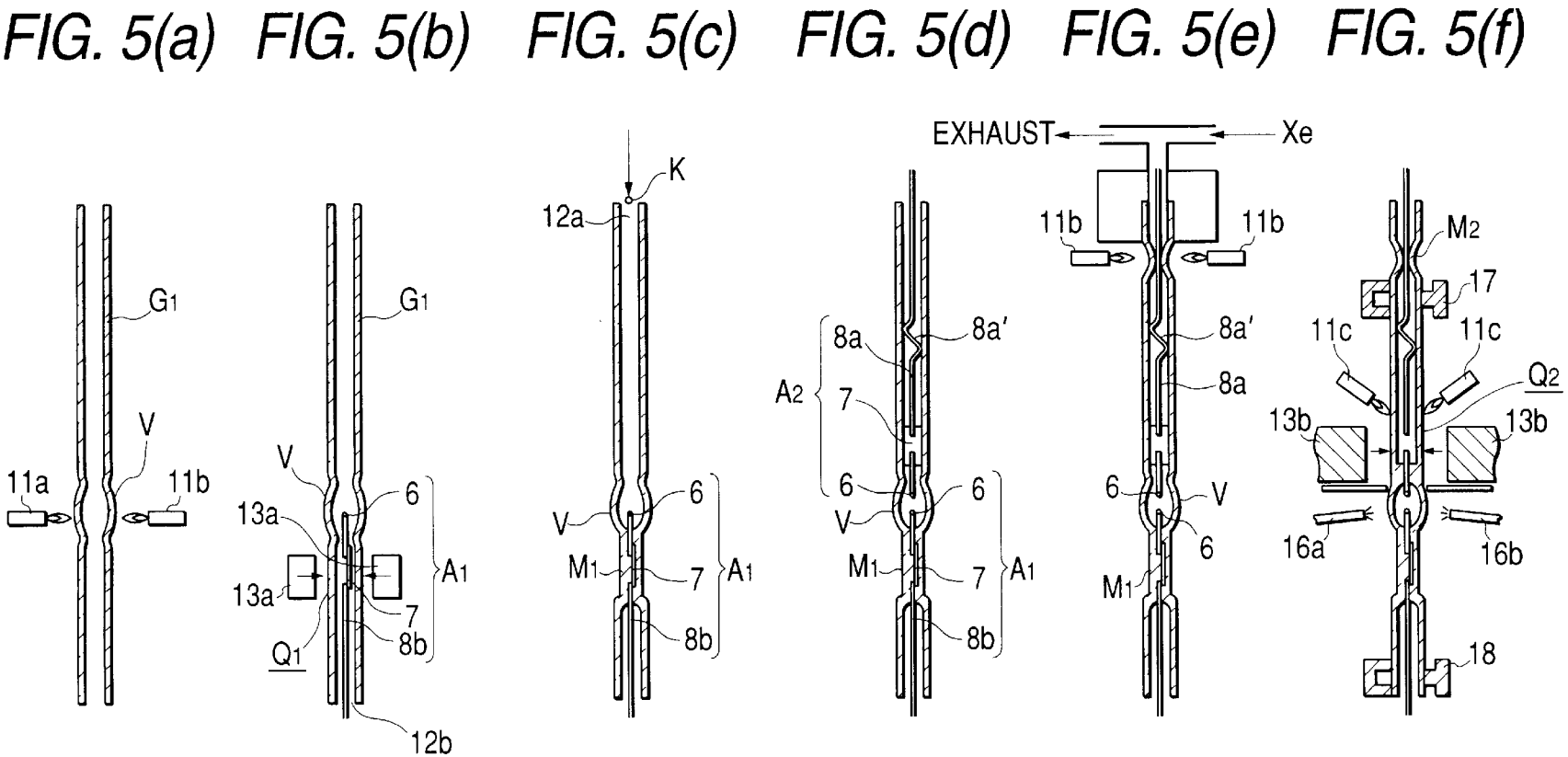
FIGS. 5(*a*) to 5(*f*) are views schematically showing an arc tube manufacturing process.

Next, the following is a description on a preferable manufacturing process of the discharge bulb 1 according to the present invention. The manufacturing process is largely classified into two processes, that is, a manufacturing process of the arc tube 2 and a sealing process of the shroud glass tube 3. FIGS. 5(*a*) to 5(*f*) are views schematically showing a flow of the manufacturing process of the arc tube 2, whereas FIGS. 6(*a*) to 6(*c*) are views schematically showing a flow of the sealing process of the shroud glass tube 3.

Manufacturing Process of Arc Tube 2

First, the manufacturing process of the arc tube 2 will be described below with reference to FIGS. 5(*a*) to 5(*f*).

A cylindrical silica (quartz) glass tube having a predetermined caliber is vertically held by a predetermined retaining member (not shown) and, then, a spherical bulged portion V is formed by thermoforming using a burner 11*a*, or the like, at the substantially center portion of the longitudinal direction of the glass tube (see FIG. 5(*a*)) to form the glass tube $G_1$.

An electrode assembly $A_1$ is inserted from one open end 12*b* of the cylindrical glass tube $G_1$ including the spherical bulged portion V and, then, is held at a predetermined position. The electrode assembly $A_1$ is formed from a tungsten discharge electrode (rod) 6, a molybdenum foil 7, and the lead wire 8*b*, that are previously connected integrally with each other. Then, the glass tube $G_1$ is subjected to a primary pinch seal using a pincher 13*a* at a position $Q_1$ near the spherical bulged portion V (see FIG. 5(*b*)).

In the primary pinch seal, the glass tube $G_1$ is kept at a depressurized state and, in order to prevent the electrode assembly $A_1$ from being oxidized, a forming gas is supplied into the glass tube $G_1$ from a predetermined nozzle (not shown). In FIGS. 5 (*c*) to 5 (*e*), a reference numeral $M_1$ denotes a primary pinch seal portion.

Next, a light emitting substance K, or the like, is put into the spherical bulged portion V from the other open end 12*a* of the cylindrical glass tube $G_1$ (see FIG. 5(*c*)). Thereafter, another electrode assembly $A_2$ is inserted therein so as to be held at a predetermined position (FIG. 5(*d*)). The electrode assembly $A_2$ is formed from a tungsten discharge electrode (rod) 6, a molybdenum foil 7, and the lead wire 8*a*, that are previously connected integrally with each other.

In this case, the leadwire 8*a* is provided with a W-shaped bent portion 8*a*' on the middle portion of the lead wire 8*a*. The bent portion 8*a*' is in a state of being abutted against the inner wall surface of the glass tube $G_1$; therefore, it serves to position and hold the electrode assembly $A_2$ at a predetermined position.

Subsequently, the cylindrical glass tube $G_1$ is forcedly exhausted and, thereafter, the upper predetermined portion of the glass tube $G_1$ is crimped by a burner 11*b* while a discharge starting gas (e.g., xenon gas) is supplied into the glass tube $G_1$. By doing so, the discharge starting gas and the light emitting substance K are enclosed in the glass tube (see FIG. 5(*e*)). A reference numeral $M_2$ denotes a crimped portion.

Thereafter, the spherical bulged portion V is cooled by liquid nitrogen ($LN_2$) injected from the nozzles 16*a* and 16*b* so that the discharge starting gas and the light emitting substance K are not vaporized. While the glass tube is heated by a burner 11*c* at a position $Q_2$ (where molybdenum foil 7 is disposed) near the spherical bulged portion V, it is secondarily pinch-sealed by a pincher 13*b* so as to hermetically seal the spherical bulged portion V (see FIG. 5(*f*)). Reference numerals 17 and 18 denote glass-retaining members.

Finally, the end portion of the glass tube $G_1$ is cut to a predetermined length and, thereby, discharge electrodes 6 and 6 are oppositely arranged between a pair of pinch seal portions 202*a* and 202*b* at front and rear portions of the glass tube. In this manner, the arc tube 2 having the light emitting portion 201, in which the discharge starting gas and the light emitting substance K are enclosed, is completed. The manufacturing process has been described in detail in Japanese Patent Application Laid-Open No. 10-27574, which is hereby incorporated by reference.

Gas Filling and Sealing Processes of Shroud Glass Tube 3

Figures 6A, 6B, 6C:
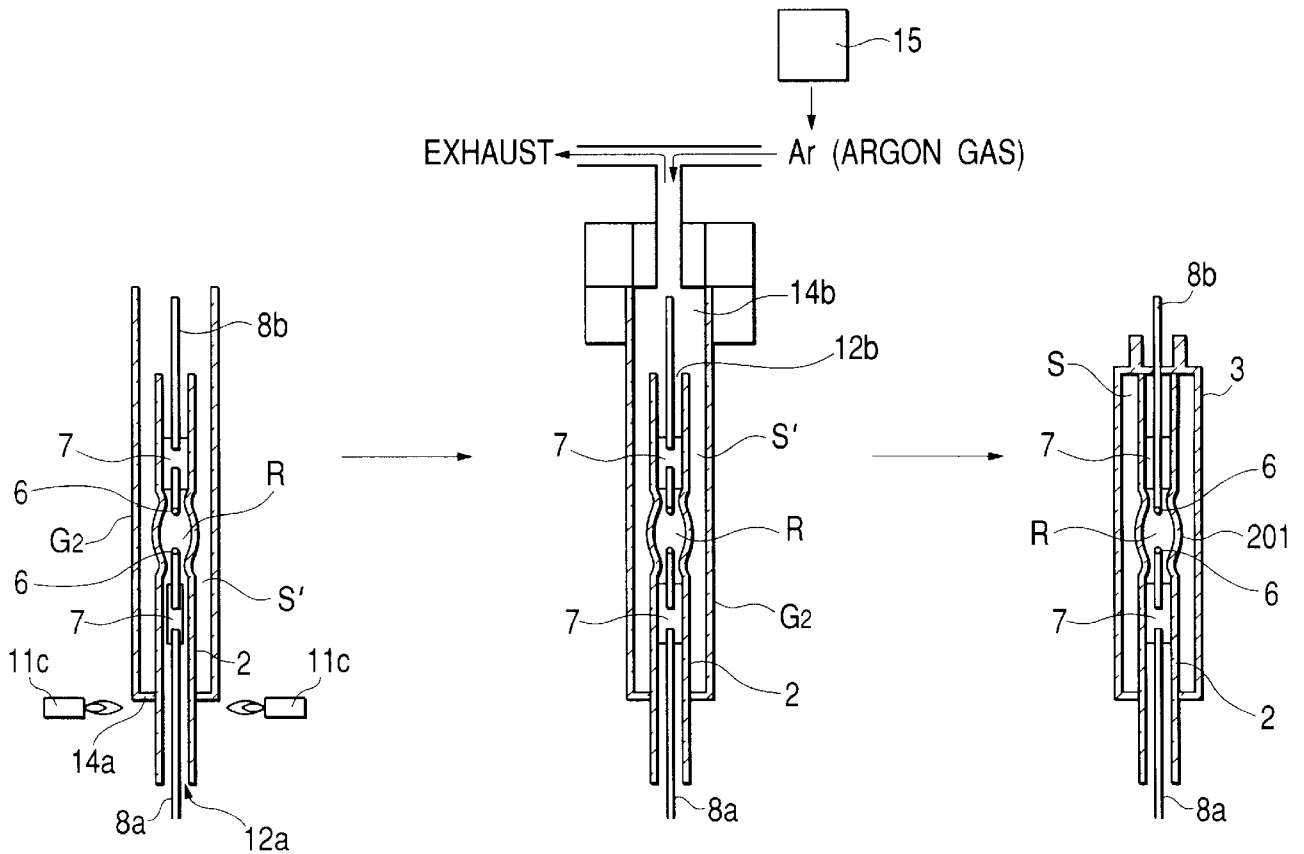
FIGS. 6(*a*) to 6(*c*) are views schematically showing a gas filling (introducing) process and a shroud glass tube sealing process.

Next, a gas filling process and a sealing process of the shroud glass tube 3 will be described below with reference to FIGS. 6(*a*) to 6(*c*). First, a cylindrical glass tube $G_2$ having a caliber larger than the cylindrical glass tube $G_1$ is prepared and, then, is held at a predetermined position so as to cover the arc tube 2. Next, a lower end portion 14*a* of the cylindrical glass tube $G_2$ is thermally welded, by a burner 11*c*, between the end portion 12*a* and the primary pinch seal portion. See FIG. 6(*a*).

Subsequently, the gas filling process shown in FIG. 6(*b*) is carried out. More specifically, the atmosphere in a space S'—formed between the arc tube 2 and the cylindrical glass tube $G_2$—is forcedly exhausted and, then, an industrial argon gas having a water content of less than 130 ppm per atmospheric pressure, and being enclosed at a high pressure (150 kgf/cm$^2$) within a cylinder 15, is communicated to the space S'. In this case, the argon gas is regulated so as to be several atm, preferably in the range of 0.3 to 15 atm, within the space S'.

Finally, an upper end portion 14*b* of the cylindrical glass tube $G_2$ is thermally welded (for example, shrink-sealed) to the upper end 12*b* of the arc tube 2 so as to hermetically seal the space S' into the space S. In the process for sealing the shroud glass tube 3, the shroud glass tube 3 is cooled by liquid nitrogen or the like and, thereby, the argon gas is liquefied. In this manner, it is possible to complete the shroud glass tube 3 including the sealed space S having predetermined water content and specified pressure condition (see FIG. 6(*c*)).

According to the present invention, in a discharge bulb and a discharge bulb manufacturing method, the water content of gas enclosed in a sealed space-formed between the arc tube and the shroud glass tube hermetically sealing the arc tube is specified, and is set less than a predetermined value. The arc tube includes a light emitting portion which is constructed in a manner that discharge electrodes are oppositely arranged in a glass sphere in which a light emitting substance is enclosed by pinch-sealing the glass tube. By doing so, even if the discharge bulb is used for a long time, it hardly becomes dewy, and there is no problem of facilitating devitrification (whitening) and expansion by capillary condensation of water content in a narrow space between the light emitting portion and the shroud glass tube. Therefore, it is possible to improve durability of the discharge bulb, and to achieve a long lifetime of the discharge bulb.

Moreover, the pressure of gas enclosed in the sealed space formed between the arc tube and the shroud glass tube-is specified and, further, is set within a predetermined range, whereby it is possible to securely prevent an expansion of the light emitting portion when the discharge bulb is turned on. More specifically, it is possible to securely prevent the following problems: the light emitting portion closely approaching the inner wall surface of the shroud glass tube, whereby devitrification occurs; and the light emitting portion contacting with the inner wall surface of the shroud glass tube, whereby leak or breakdown is generated.

The present invention is not limited to the specific above-described embodiments. It is contemplated that numerous modifications may be made to the discharge bulb, and manufacturing method thereof, according the present invention without departing from the spirit and scope of the invention as defined in the following claims.

What is claimed is:

1. A discharge bulb including:

an arc tube having a light emitting portion constructed in a manner that a light emitting substance is enclosed therein by pinch-sealing the arc tube, and discharge electrodes are oppositely arranged therein; and a shroud glass tube hermetically sealing and covering the arc tube, so as to form a sealed space between said shroud glass tube and said arc tube, wherein water content of gas enclosed in said sealed space is set to less than 130 ppm.

2. The discharge bulb according to claim 1, wherein the light emitting portion is formed so as to closely approach an inner wall surface of the shroud glass tube, and a gas is enclosed in the sealed space within a range from a lower atmospheric pressure limit calculated by 3–6 d to an upper pressure limit of 15 atmospheres pressure, wherein a distance from the inner wall surface of the shroud glass tube to a zenith portion of the light emitting portion is set as reference numeral d (in the unit of mm).

3. The discharge bulb according to claim 1, wherein said enclosed gas is set to the water content of less than 130 ppm before said gas is introduced into said sealed space.

4. The discharge bulb according to claim 1, wherein said enclosed gas is Argon.

5. A manufacturing method of a discharge bulb including (i) an arc tube having a light emitting portion constructed in a manner that a light emitting substance is enclosed therein by pinch-sealing the arc tube, and discharge electrodes are oppositely arranged therein, and (ii) a shroud glass tube hermetically sealing and covering the arc tube, said manufacturing method comprising:

a gas filing process for filling a gas into a space formed between the arc tube and the shroud glass tube, wherein the gas filling process includes a gas introducing process for introducing a gas having a specified water content of less than 130 ppm into the space; and a sealing process for sealing the shroud glass tube.

6. The manufacturing method of a discharge bulb according to claim 5, wherein the gas introducing process is carried out within a range of from 0.3 to 15 atmospheres pressure.

7. The manufacturing method of a discharge bulb according to claim 6, wherein the sealing process is carried out so that the shroud glass tube is cooled, whereby the gas is liquefied.

8. The manufacturing method of a discharge bulb according to claim 5, wherein the sealing process is carried out so that the shroud glass tube is cooled, whereby the gas is liquefied.

9. The manufacturing method of a discharge bulb according to claim 5, further comprising:

a setting process for setting the water content before the gas filling process.

10. The manufacturing method of a discharge bulb according to claim 5, wherein said gas is Argon.

* * * * *